US008657621B2

(12) United States Patent
Fujiwara

(10) Patent No.: US 8,657,621 B2
(45) Date of Patent: Feb. 25, 2014

(54) CONNECTOR APPARATUS

(75) Inventor: Michiyo Fujiwara, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 177 days.

(21) Appl. No.: 13/348,883

(22) Filed: Jan. 12, 2012

(65) Prior Publication Data

US 2012/0208395 A1 Aug. 16, 2012

(30) Foreign Application Priority Data

Feb. 16, 2011 (JP) ..... 2011-031097

(51) Int. Cl.
*H01R 4/26* (2006.01)

(52) U.S. Cl.
USPC ..... 439/489; 439/188

(58) Field of Classification Search
USPC ..... 439/489, 188, 187, 189, 544, 554, 439/607.28, 607.44, 607.49, 250, 366, 698, 439/830, 620.21, 620.26, 620.27, 620.28, 439/620.3, 620.33, 620.34; 200/51.09, 200/51.1, 51.11, 51.12
See application file for complete search history.

(56) References Cited

U.S. PATENT DOCUMENTS

| | | | | |
|---|---|---|---|---|
| 3,820,355 | A | 6/1974 | Olivares | |
| 5,174,776 | A * | 12/1992 | Ohtaka et al. | 439/188 |
| 5,647,754 | A * | 7/1997 | Kohno | 439/188 |
| 5,651,693 | A * | 7/1997 | Fukuda et al. | 439/489 |
| 2004/0214470 | A1 * | 10/2004 | Hori | 439/489 |

* cited by examiner

*Primary Examiner* — Renee S Luebke
*Assistant Examiner* — Harshad Patel
(74) *Attorney, Agent, or Firm* — Gerald E. Hespos; Michael J. Porco; Matthew T. Hespos

(57) ABSTRACT

A connector apparatus has an equipment-side connector (20) mounted in a case (10) and a harness-side connector (30) fit on the equipment-side connector (20) through an opening in the case (10). Fit-on detection mechanisms (27, 40) for detecting connection of the equipment-side connector (20) and the harness-side connector (30) are provided therebetween. The fit-on detection mechanism (27) of the equipment-side connector (20) has two male tabs (28). The fit-on detection mechanism (40) of the harness-side connector (30) has a shorting terminal (50) and two relay terminals (55). The shorting terminal (50) has a coupling plate (51) and two pins (52) projecting from the coupling plate (51). The relay terminals (55) have connection parts (57) at both ends for connecting to the pins (52) of the shorting terminal (50) and to the male tabs (28).

9 Claims, 23 Drawing Sheets

CONNECTOR APPARATUS

BACKGROUND OF THE INVENTION

1. Field of the Invention

The invention relates to a connector apparatus having a fit-on detection mechanism.

2. Description of the Related Art

A known connector apparatus for supplying electric power to apparatuses in an electric car has an equipment-side connector and a harness-side connector to be fit together. The equipment-side connector has a fit-on concavity that defines a male housing formed integrally with an outer surface of a junction box (J/B) and a male terminal in the form of a bus bar projects from the inner surface of the fit-on concavity. The J/B is accommodated in a metal case. The fit-on concavity of the male housing has an open surface disposed at the back side of an opening in the case. The harness-side connector has a female housing and a female terminal connected to an end of an electric wire is accommodated in the female housing. The harness-side connector is fit on the equipment-side connector through the opening of the case to connect corresponding female and male terminal fittings together. A shielding shell is mounted to cover the male housing and is fixed to the case by tightening a bolt.

The harness-side connector of the above-described connector apparatus may be removed from the equipment-side connector for maintenance. As a result, the male terminal of the equipment-side connector is exposed outside through the opening of the case. The equipment-side connector has the power supply electric circuit and an operator who carelessly touches the male terminal may be subjected to an electric shock. Therefore, fit-on detection mechanisms are provided between the connectors for detecting the fit-on and separation of the connectors and for performing an interlocking function for cutting-off of the power supply electric circuit in dependence on detection of the fit-on and the separation between the connectors. A connector apparatus having this kind of the interlocking function is described in U.S. Pat. No. 3,820,355.

The conventional fit-on detection mechanism for the above-described interlocking function includes two tab shaped fit-on detection terminals disposed alongside the equipment-side connector and a short harness associated with the harness-side connector. The short harness has female terminals connected to both ends of an electric wire curved like a hair pin. The tab shaped fit-on detection terminals are fit with the female terminals of the short harness when both connectors are fit together so that the power supply electric circuit has a conductive state. The tab shaped fit-on detection terminals separate from the corresponding female terminals of the short harness when the connectors are separated from each other to cut off the power supply electric circuit.

The J/B where the equipment-side connector has been mounted is accommodated inside the case and is fixed to the case with a bolt or the like. Tolerance in relation to the mounting of the J/B on the case may cause a variation between the dimension of the opening of the case and that of the open plane of the fit-on concavity of the male connector. Thus, the fit-on depth of the female housing of the harness-side connector may vary with respect to the fit-on concavity of the male housing of the equipment-side connector. The power supply female and male terminals on both connectors are comparatively large. Thus, the connection state is secured, even though there is a variation in the fit-on depth within the tolerance.

On the other hand, the fit-on detection terminal fitting is small, and the tab shaped fit-on detection terminals normally cannot be connected with the mating female terminals when the fit-on depth is small within the tolerance. As a result, the power supply electric circuit remains cut off. The length of the tab-shaped fit-on detection terminals could be set large to prevent such a situation from occurring. However, when the fit-on depth is large within the tolerance, the front ends of the tabs pass through the connection portions of the female terminals and strike against an exposed portion of the core wire crimped to the barrel disposed rearward from the connection portions of the female terminals. Therefore it is difficult to deal with this problem.

The present invention has been completed based on the above-described situation and has for its object to securely detect fit-on between an equipment-side connector and a harness-side connector irrespective of the degree of a tolerance in mounting the equipment-side connector on a case.

SUMMARY OF THE INVENTION

The invention provides a connector apparatus with an equipment case that has an opening. An equipment-side connector is disposed inside the case at a position facing the opening for and has a first connection terminal. A harness-side connector is connected to an end of a wire harness and has a second connection terminal to be connected to the first connection terminal. The harness-side connector is fit on the equipment-side connector through the opening of the case and a mounting part provided on the harness-side connector is fixed to the case. The connector apparatus further comprises fit-on detection mechanisms disposed at the equipment-side connector and the harness-side connector for detecting connection between the equipment-side connector and the harness-side connector. The fit-on detection mechanism of the equipment-side connector comprises two fit-on detection male terminals. The fit-on detection mechanism of the harness-side connector comprises a shorting terminal and two relay terminals. The shorting terminal has a coupling and two pins projecting from the coupling. Each relay terminal has spaced apart connection parts formed at opposite ends in a length direction thereof for connecting the pins of the short pin with the male terminals.

The harness-side connector has the shorting terminal and the pins thereof are connected with the connection parts of the relay terminals. The mounting part of the harness-side connector is fixed to the case after the harness-side connector is fit on the equipment-side connector through the opening of the case. As a result, the corresponding connection terminals of both connectors are connected to each other, and both fit-on detection male terminals of the equipment-side connector are connected to connection parts of the relay terminals. As a result, both male terminals become conductive and it is detected that both connectors have been fit together.

A variation may exist between the dimension of the opening of the case and that of the fit-on surface of the equipment-side connector due to manufacturing tolerance. Thus, a variation may occur in the fit-on depth of the harness-side connector with respect to the equipment-side connector. However, the variation is absorbed by changing the projected lengths of both male terminals of the equipment-side connector in the range from the front ends thereof to the gap formed between both connection parts of the relay terminal. As a result, the connection between the relay terminal and the male terminals is secured.

The fit-on detection part of the harness-side connector has the shorting terminal and the relay terminal, and the tolerance in mounting the equipment-side connector on the case can be absorbed in the gap between the front and rear connection parts of the relay terminal. Thus the fit-on between both housings can be detected securely. Existing articles can be used as the shorting terminal and the relay terminal. Thus, the construction of the invention is less expensive than conventional short harness.

A mounting hole is formed on a fit-on end surface of the harness-side connector and is open at a front end of the harness-side connector. A press-fit groove is formed on an inner surface of the mounting hole and the coupling of the shorting terminal can be press fit therein. A cover also can be inserted into the mounting hole from the front. The cover has two accommodation chambers and the relay terminals can be inserted therein from the rear. Terminal insertion openings are formed at a front ends of the accommodation chambers and can receive the fit-on detection male terminals. A removal prevention part is formed between the cover and the mounting hole for preventing the cover from being removed from the mounting hole.

The fit-on detection part of the harness-side connector is formed by inserting the shorting terminal into the press-fit groove of the mounting hole and fixing the shorting terminal thereto. Additionally, the pins of the shorting terminal are inserted into relay terminals respectively to connect the rear connection parts of the relay terminals to the pins of the shorting terminal. The cover then is inserted into the mounting hole so that the relay terminals are accommodated in the respective accommodation chambers, and the removal prevention part fixes the cover to the mounting hole to prevent the cover from being removed.

Two of the male terminals project from a fit-on end surface of the equipment-side connector and are surrounded by a wall. The cover is mounted inside the mounting hole of the harness-side connector with a clearance between an inner peripheral surface of the mounting hole and a peripheral surface of the cover and the wall can be inserted into the clearance. A rib is formed on an inner end of an outer surface of the cover to prevent the cover from radially shifting.

The cover can be inserted into the mounting hole and is prevented from shifting radially. Thus, the cover can be inserted smoothly into the mounting hole while the previously mounted relay terminal is inside the accommodation chamber so that the cover can be inserted into the mounting hole efficiently.

A power supply electric circuit on the equipment-side connector is conductive when two of the fit-on detection male terminals are connected electrically to each other, whereas the power supply electric circuit is cut off when the fit-on detection male terminals are not connected electrically to each other. The fit-on detection mechanism can be applied effectively as an interrupting device of a power supply electric circuit.

The equipment case is made of a metal. A shielding shell is mounted on the harness-side connector to surround the other connection terminal. A mounting plate projects from the shielding shell and is fixed to the outer surface of the equipment case with a tightening metal fitting. This construction can be applied effectively to a connector apparatus that has a shielding function.

According to the present invention, it is possible to securely detect the fit-on between the equipment-side connector and the harness-side connector irrespective of the degree of a tolerance in mounting the equipment-side connector on the case.

DETAILED DESCRIPTION OF THE PREFERRED EMBODIMENTS

A connector apparatus in accordance with the invention is illustrated in FIGS. 1 through 25 and is part of an electric system for connecting a battery to apparatuses mounted on a car. The connector apparatus includes an equipment-side connector 20 mounted in a case 10 and a harness-side connector 30 connected to an end of a wire harness and configured to mate with the equipment-side connector 20.

Figure 2:
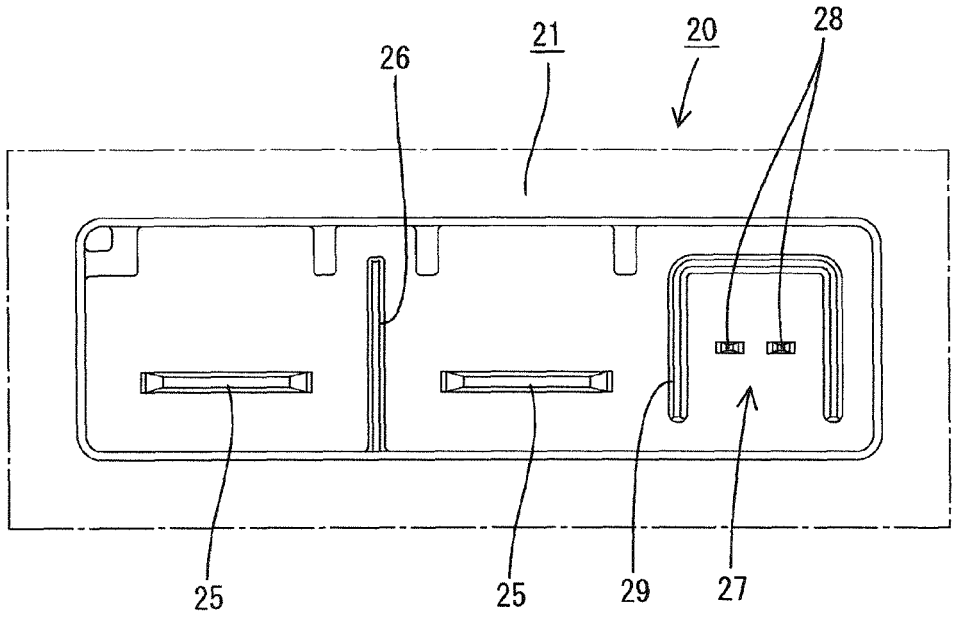
FIG. 2 is a plan view of the equipment-side connector.

The equipment-side connector 20 includes an integrally formed male housing 21 with a junction box 22 (hereinafter referred to J/B 22) and a fit-on concavity 23 on an outer surface of the J/B 22. As shown in FIG. 2, the fit-on concavity 23 is a wide rectangle divided into three regions in the right-to-left direction. Wide bus bars 25 project from an inner bottom surface of the central and left-hand regions of the fit-on concavity 23. The bus bars 25 are disposed side by side in the right-to-left direction of the male housing 21 so that plate surfaces thereof are in a common plane. The bus bars 25 have a projecting dimension equal to about 70% of the depth of the fit-on concavity 23. A low partitioning wall 26 is between the bus bars 25.

A fit-on detection part 27 of the equipment-side connector 20 is at a right region in the fit-on concavity 23, as shown in FIG. 2. More specifically, two male tabs 28 project from a central portion of the inner surface of the right region and are disposed side by side at a predetermined interval in the right-to-left direction. The male tabs 28 have a projecting dimension more than 30% of the depth of the fit-on concavity 23. A U-shaped wall 29 projects from the inner surface of the right region of the fit-on concavity 23 and surrounds three sides of the male tabs 28. The wall 29 projects slightly more than the male tabs 28.

Although not shown in the drawings, a power supply electric circuit is constructed on the equipment-side connector 20. The power supply electric circuit has a conductive state when the male tabs 28 are connected electrically to each other, whereas the power supply electric circuit is cut off electrically when the male tabs 28 are not connected electrically to each other.

Figure 1:
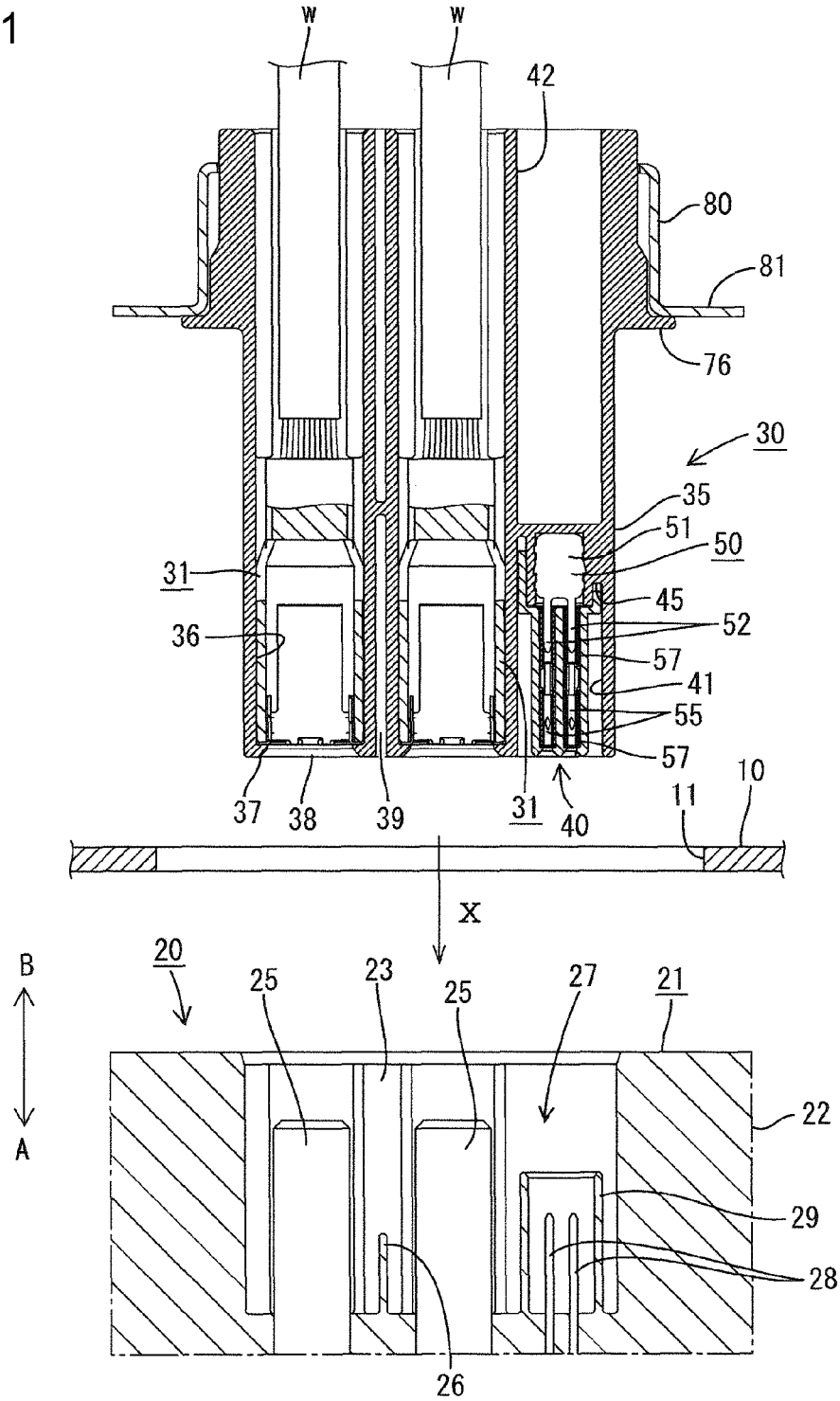
FIG. 1 is an exploded sectional view showing a harness-side connector and an equipment-side connector in accordance with the invention.

The J/B 22 that has the equipment-side connector 20 mounted therein is accommodated inside the case 10, which is made of a metal, such as aluminum, to provide a shielding function. More specifically, a rectangular opening 11 is on the case 10 and is slightly larger than an opening of the fit-on concavity 23 of the equipment-side connector 20, as shown in FIG. 1. The J/B 22 is fixed to the case 10 by an unillustrated bolt so that the fit-on concavity 23 of the equipment-side connector 20 aligns with the opening 11.

Figure 3:
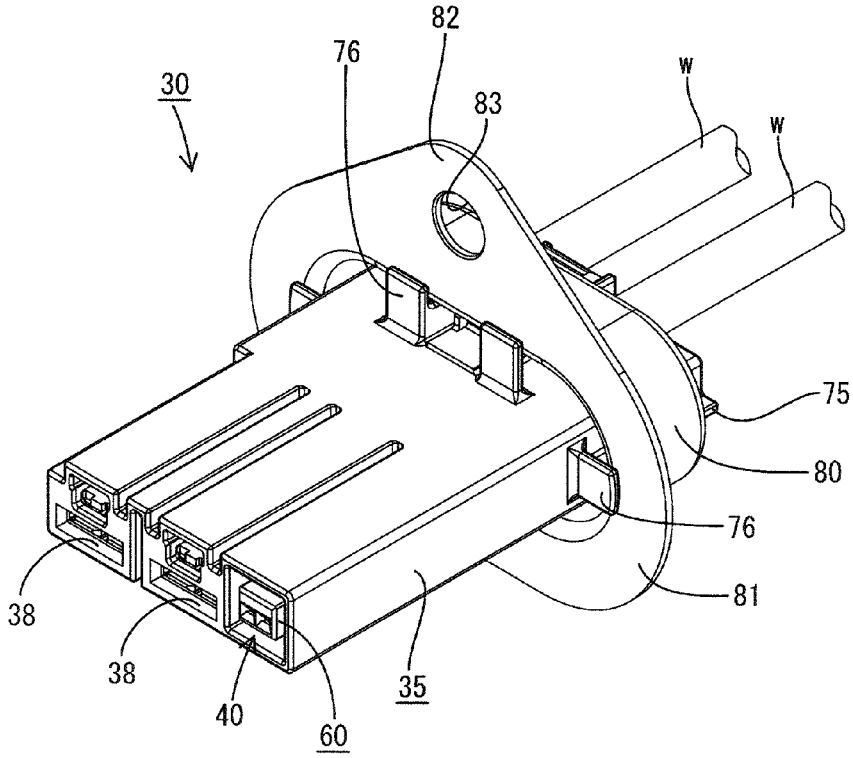
FIG. 3 is a perspective view of the harness-side connector.
Figure 4:
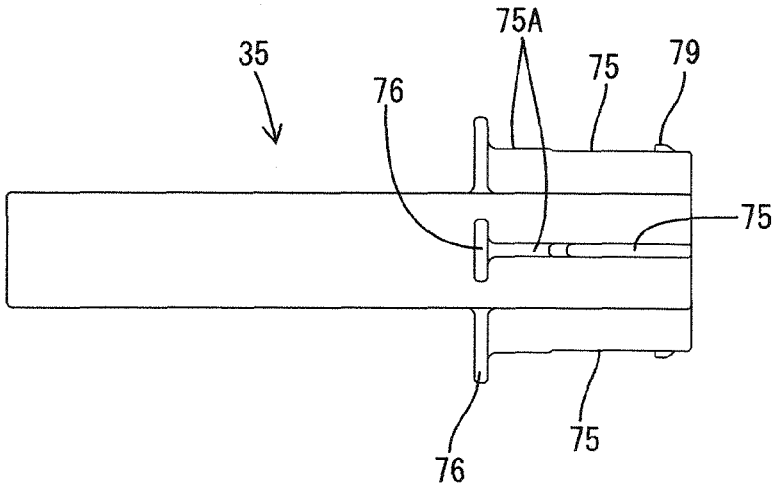
FIG. 4 is a side elevation of a female housing.
Figure 5:
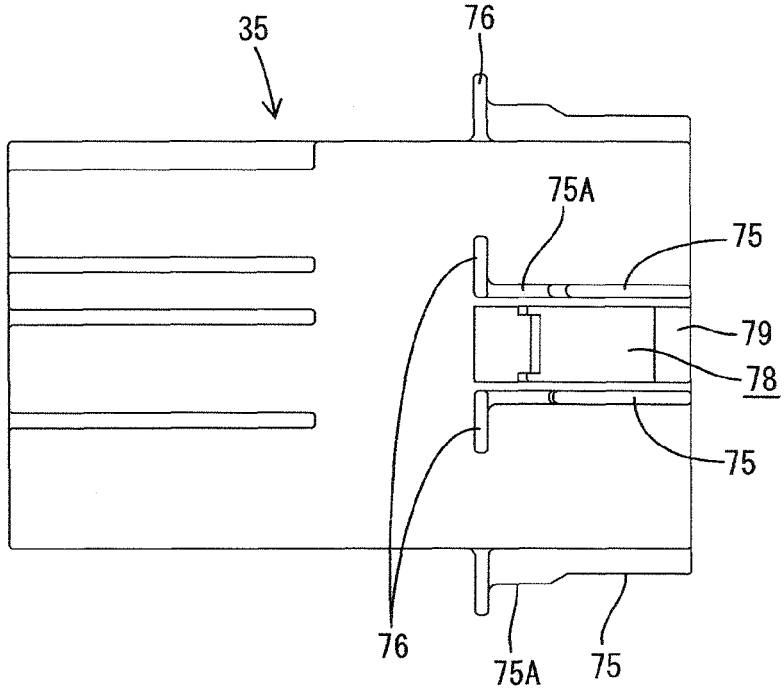
FIG. 5 is a plan view of the female housing.
Figure 6:
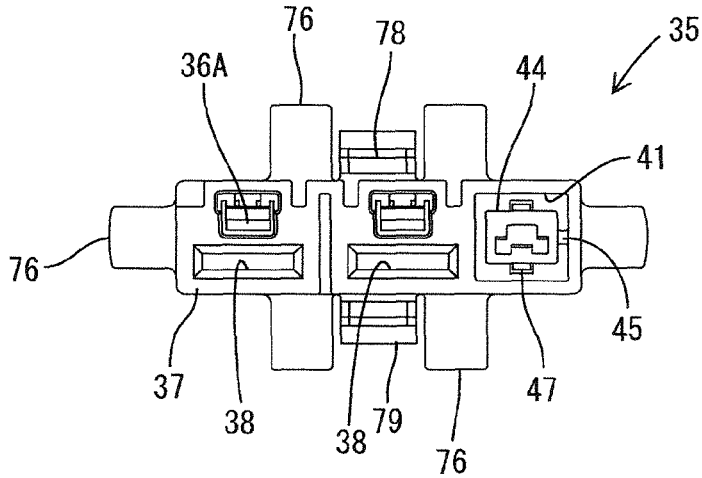
FIG. 6 is a front view of the female housing.
Figure 7:
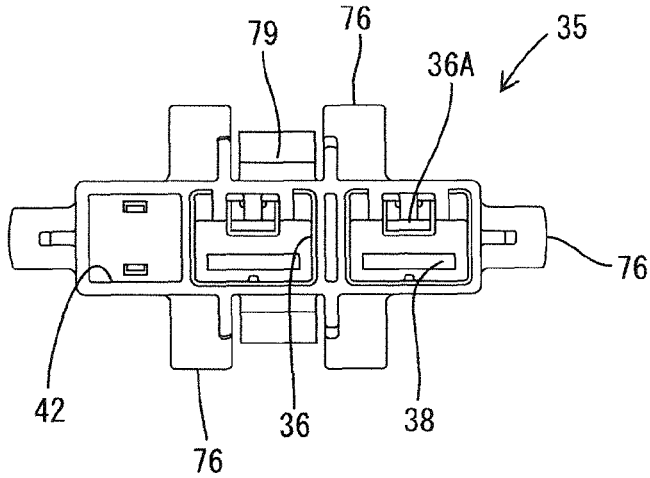
FIG. 7 is a rear view of the female housing.
Figure 8:
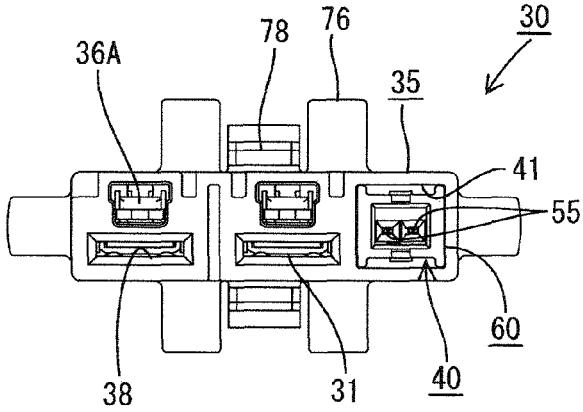
FIG. 8 is a front view of the harness-side connector before a shielding shell is mounted thereon.

As shown in FIG. 3, the harness-side connector 30 has female terminals 31 fixed to ends of electric wires w and accommodated in a female housing 35. A shielding shell 80 is fit on the rear end of the female housing 35.

Figure 22:
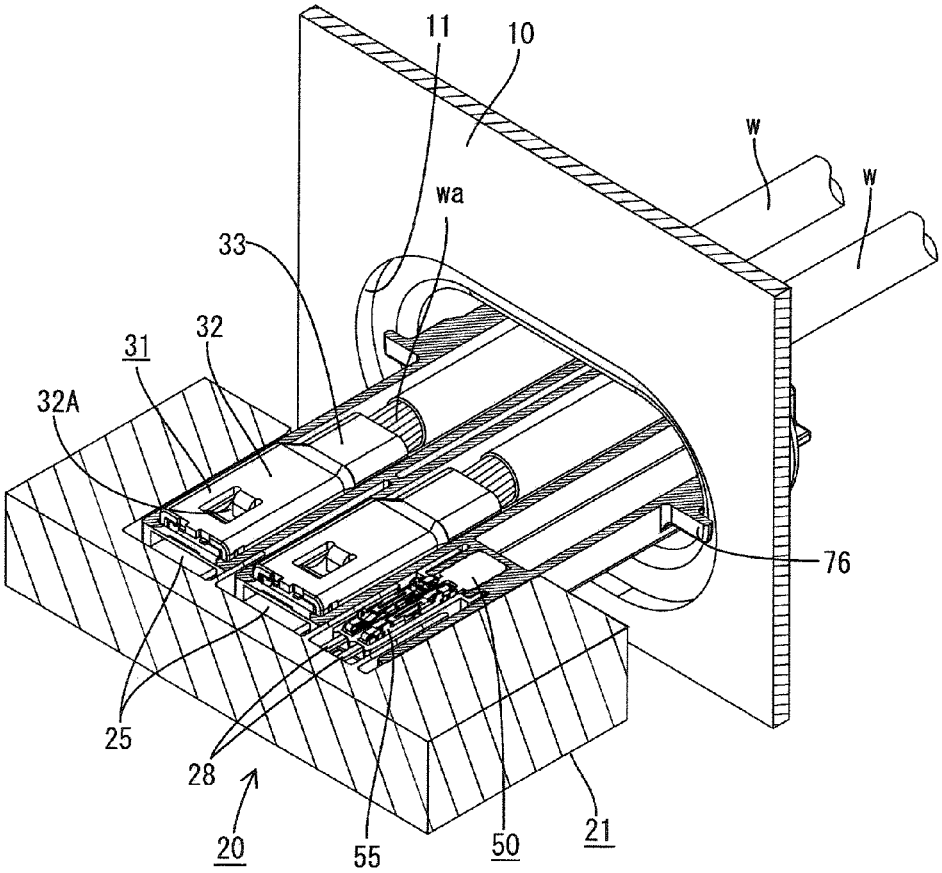
FIG. 22 is a partly cut-away perspective view showing the equipment-side connector and the harness-side connector that have been fit normally together.

The female terminal 31 is formed by press working a metal plate that has excellent conductivity. As shown in FIG. 22, the female terminal 31 has a flat quadrangular prism-shaped connection part 32 and the bus bars 25 provided on the equipment-side connector 20 are fit in and connected to the connection part 32. A barrel 33 is disposed rearward from the connection part 32 and is crimped to a core wire wa that has been exposed by peeling insulation from the end of the electric wire w. Thus, the barrel 33 is fixed to the end of the electric wire w.

The female housing 35 is made of a synthetic resin and, as shown in FIGS. 4 through 7, has a flat block-shape that can fit tightly inside the fit-on concavity 23 of the male housing 21. The female housing 35 is divided into three regions in its right-to-left direction. Cavities 36 are formed at central and left parts of the female housing 35, as viewed from the front and a front wall 37 is forward of each cavity 36. The front wall 37 has terminal insertion openings 38 that can receive the mating bus bar 25. A lance 36A (see FIG. 6) is formed on a ceiling surface of each cavity 36 and can be locked to a lance hole 32A formed through the connection part 32 of the female terminal 31.

A guide groove 39 is formed on the front surface of the female housing 35 at a position between the cavities 36 and can receive the partitioning wall 26 erect on the inner surface of the fit-on concavity 23 of the mating male housing 31.

Each female terminal 31 is inserted into the corresponding cavity 36 from the rear and flexibly deforms the lance 36A. The fully inserted female terminal 31 strikes the front wall 37. The lance 36A then restores elastically toward its original state and fits in the lance hole 32A so that the female terminal 31 cannot be removed from the cavity 36.

A fit-on detection part 40 of the harness-side connector 30 is constructed in the right region of the female housing 35 in a front view. More specifically, a cross-sectionally square mounting hole 41 is formed at a front end in the right region of the female housing 35 and has a depth of about ¼ of the whole length of the female housing 35. The wall 29 formed at the fit-on detection part 27 of the mating male housing 21 can be fit tightly inside the mounting hole 41. A bore 42 is formed at the back side of the inner surface of the mounting hole 41.

Figure 9:
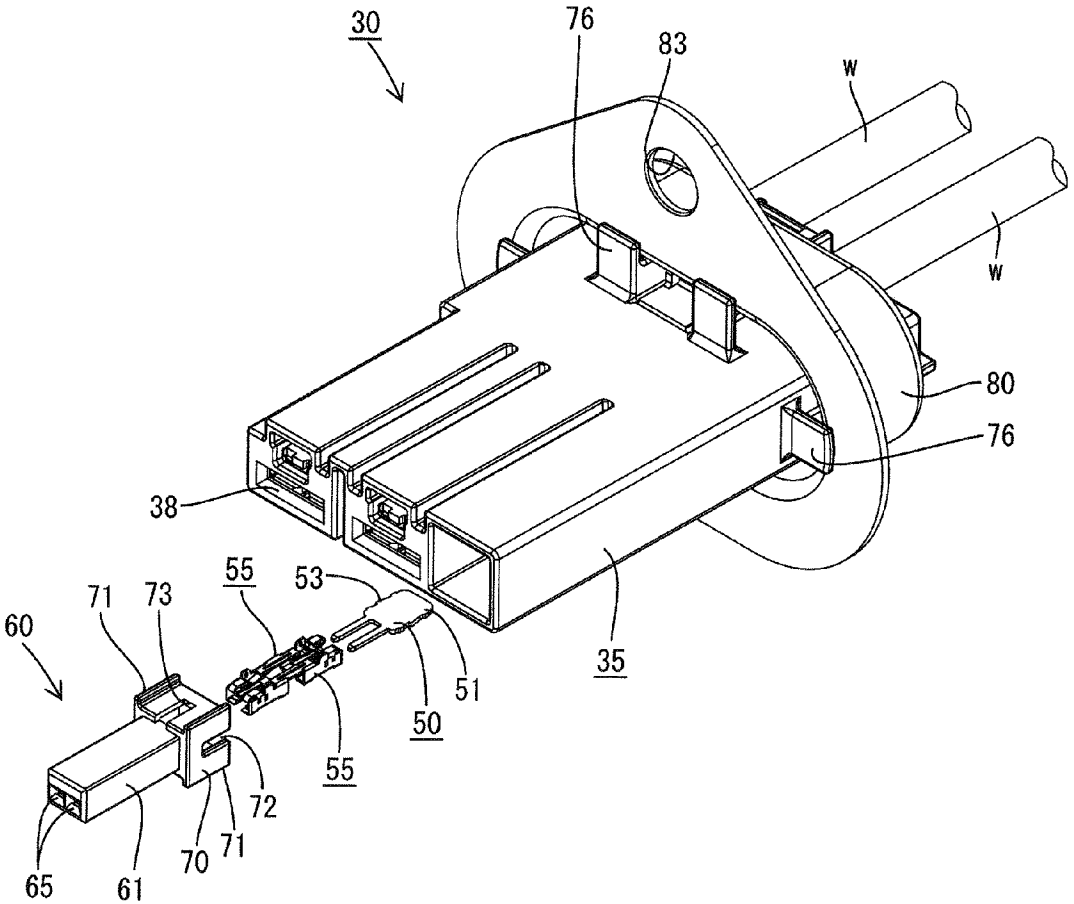
FIG. 9 is an exploded perspective view of a fit-on detection part of the harness-side connector.
Figure 10:
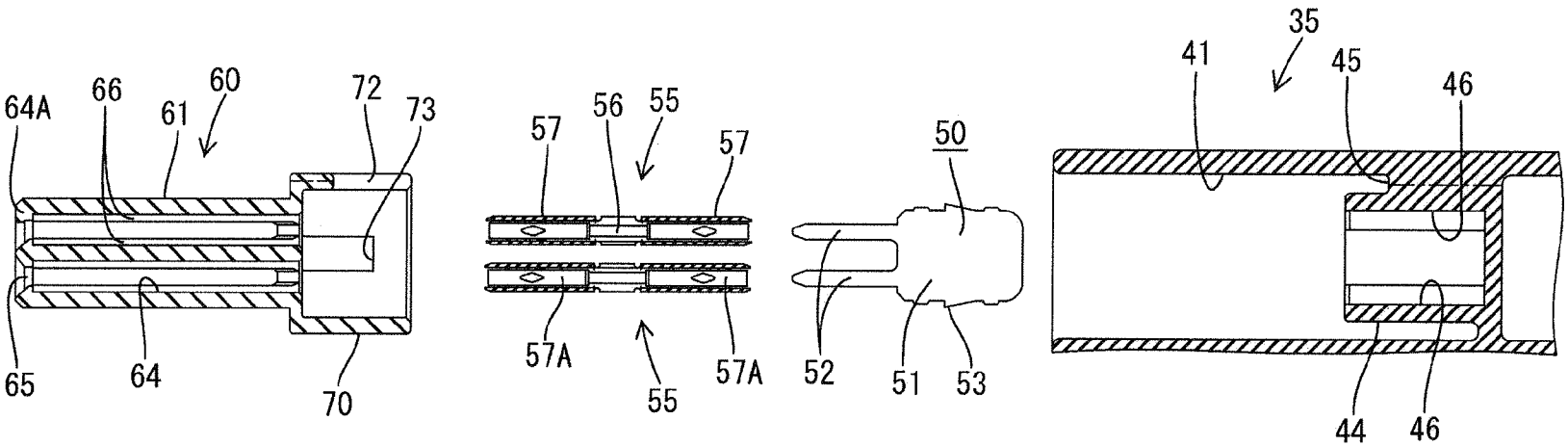
FIG. 10 is an exploded sectional view showing an operation of assembling the fit-on detection part, as viewed from a bottom surface thereof.
Figure 11:
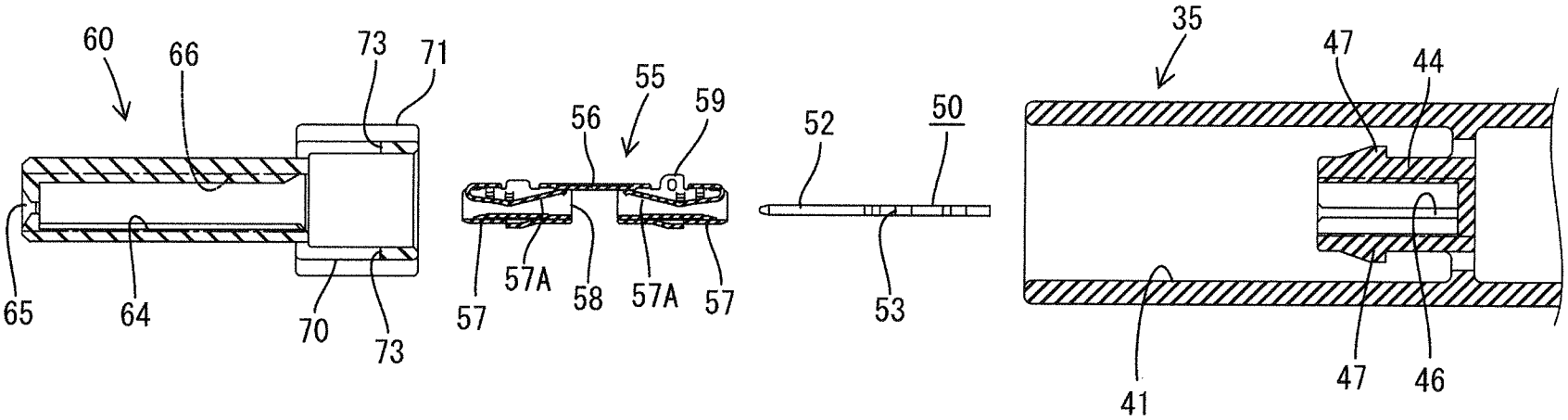
FIG. 11 is an exploded sectional view showing the operation of assembling the fit-on detection part, as viewed from a side surface thereof.
Figure 12:
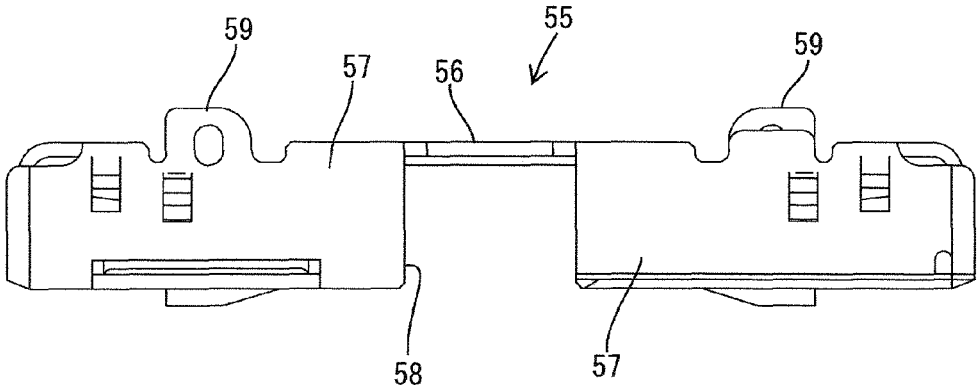
FIG. 12 is a side elevation of a relay terminal.
Figure 13:
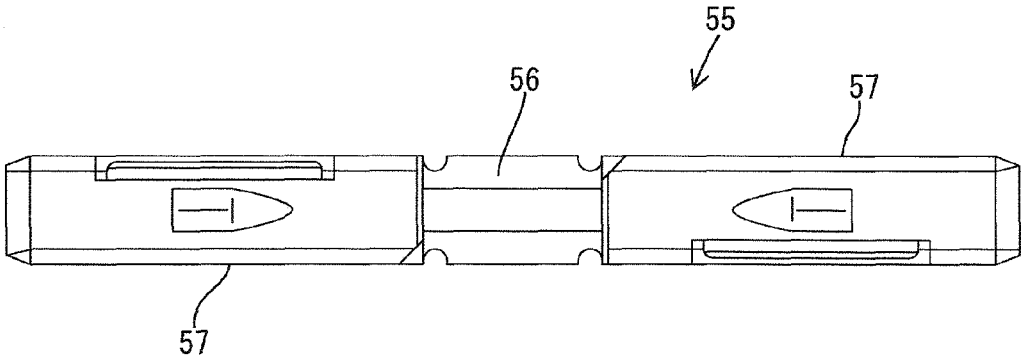
FIG. 13 is a bottom view of the relay terminal.
Figure 14:
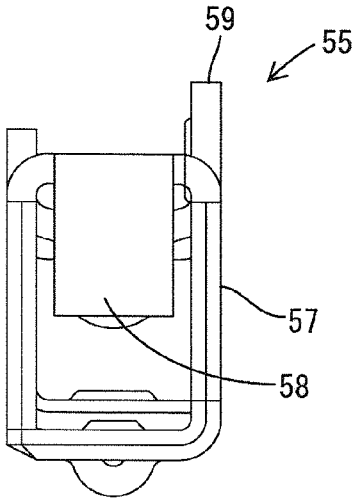
FIG. 14 is a side elevation of the relay terminal.
Figure 15:
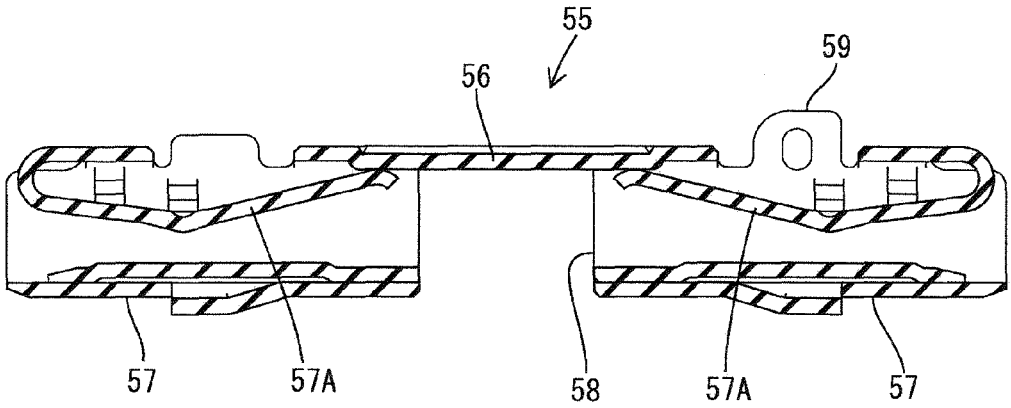
FIG. 15 is a sectional side elevation of the relay terminal.

As shown in FIGS. 9 through 11, a shorting terminal 50, a pair of relay terminals 55, and a cover 60 accommodating the relay terminals 55 are inserted into the mounting hole 41 to form a fit-on detection part 40.

The shorting terminal 50 is formed by press working a metal plate having an excellent conductivity and includes a rectangular coupling plate 51. Two pins 52 project side by side from a front end of the coupling plate 51 and are spaced from each other at an interval equal to the interval between the male tabs 28 of the fit-on detection part 27 of the male housing 21. Each pin 52 is approximately half as long as the male tab 28. Cutting projections 53 are formed on both side edges of the coupling plate 51.

A square mounting tube 44 projects from a central portion of an inner surface of the mounting hole 41 and is cross-sectionally a little smaller than the mounting hole 41. The projected length of the mounting tube 44 is approximately ⅓ of the depth of the mounting hole 41. A rib 45 is erect on a right side surface (in a front view) of the mounting tube 44 at a central height position of the right surface for preventing an erroneous insertion of the cover 60 into the mounting hole 41. The rib 45 has a length of about ⅔ of the mounting hole 41 from the inner end thereof.

Press-fit grooves 46 are formed on right and left inner surfaces of the mounting tube 44 and can receive right and left side edges of the coupling plate 51 of the shorting terminal 50. As shown in FIG. 10, the depth of the press-fit grooves 46 slightly exceeds the length of the coupling plate 51. Therefore, the cutting projections 53 on the side edges of the coupling plate 51 cut into the bottom of the press-fit grooves 46 as the coupling plate 51 of the short pin 50 is pressed into the press-fit grooves 46. A pressing operation is stopped when the coupling plate 51 strikes the inner surface of the press-fit groove 46. The coupling plate 51 pressed into the press-fit groove 46 is prevented from being removed therefrom. At this time, about 80% of the length of the pins 52 project from the front of the mounting tube 44.

Figure 23:
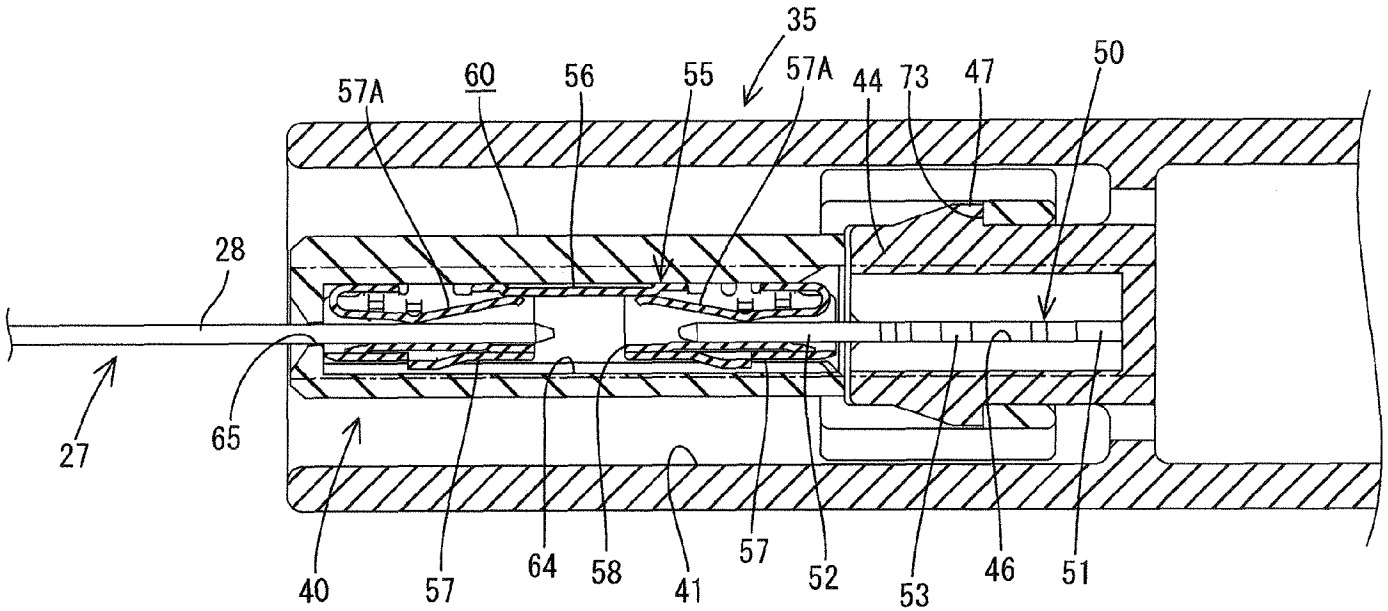
FIG. 23 is a sectional view showing a fit-on detection mechanism in the case where the equipment-side connector has been mounted on the harness-side connector at approximately the center of a tolerance range.

The two relay terminals 55 have the same configuration and are formed by press working a metal plate having an excellent conductivity. As shown in FIGS. 12 through 15, each relay terminal 55 has a base plate 56 and quadrangular prism-shaped connection parts 57 extend from the ends of the base plate 56. Each relay terminal 55 has a length equal to the depth from the entrance of the mounting hole 41 to the front of the mounting tube 44 thereof. An elastic contact strip 57A is bent in from the ceiling of each connection part 57 to define a mountain shape. As shown in FIG. 23, each connection part 57 is slightly longer than a projected length of each pin 52 of the short pin 50 from the mounting tubular part 44 to the front end thereof normally press-fit into the press-fit groove 46. A gap 58 longer than the half of the length of each connection part 57 is formed between the front and rear connection parts 57.

A stabilizer 59 is formed at an upper edge of a side surface of each connection part 57.

Figure 16:
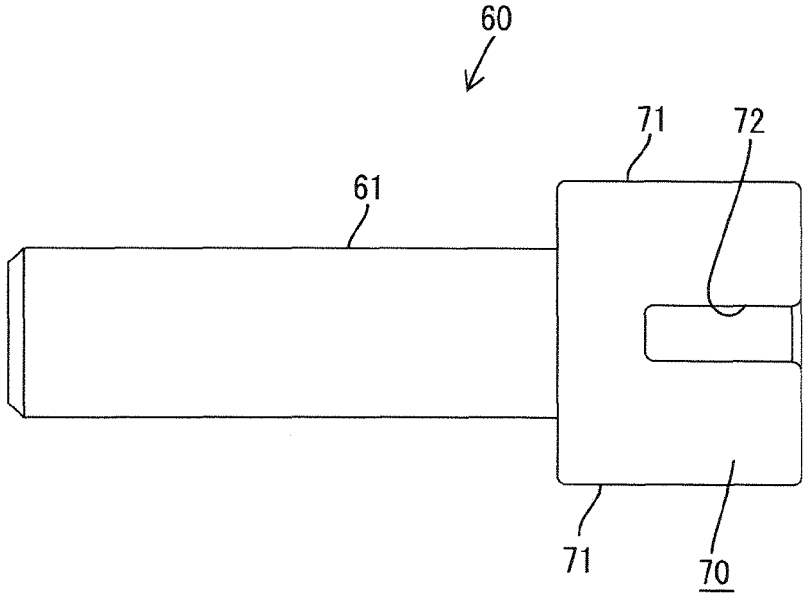
FIG. 16 is a side elevation of a cover.
Figure 17:
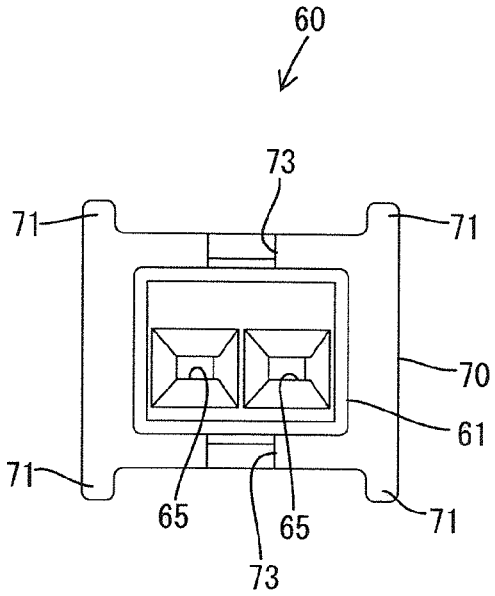
FIG. 17 is a front view of the cover.
Figure 18:
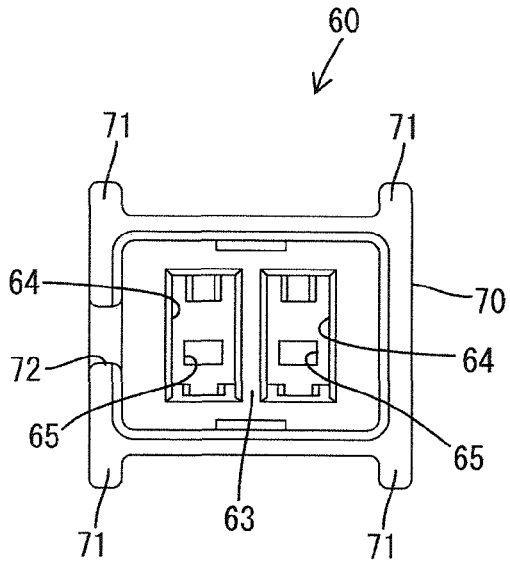
FIG. 18 is a rear view of the cover.

The cover 60 is made of a synthetic resin. As shown in FIGS. 16 through 18, the cover 60 has a quadrangular prism-shaped cover body 61 that is long in the forward and backward direction of the cover 60. A square fit-on tube 70 is formed continuously with a rear end of the cover body 61 and can be fit tightly on the periphery of the mounting tube 44. The outer configuration of the cover body 61 is a little smaller than the mounting hole 41. A square peripheral clearance 62 is secured between the peripheral surface of the cover body 61 and the inner peripheral surface of the mounting hole 41 (see FIG. 20) and can receive the projected wall 29 erect on the periphery of the male tab 28 disposed in the fit-on detection part 27 of the equipment-side connector 20. The length of the entire cover 60 is almost equal to the depth of the mounting hole 41.

Accommodation chambers 64 are formed inside the cover body 61 on opposite sides of a partitioning wall 63 and the entire length of the relay terminal 55 can be inserted tightly therein from the rear. A tab insertion opening 65 is formed through a front wall 64A of each accommodation chamber 64 and can receive the male tab 28 formed on the fit-on detection part 27 of the male housing 21. Guide grooves 66 are formed on right and left edges of a ceiling surface of each accommodation chamber 64 and can receive the stabilizer 59 of the relay terminal 55.

The outer configuration of the fit-on tube 70 is formed so that right and left surfaces thereof are fit tightly between right and left inner surfaces of the mounting hole 41. However, clearances are formed between an upper surface of the fit-on tube 70 and an upper surface of the mounting hole 41 and between a lower surface of the fit-on tube 70 and a lower surface of the mounting hole 41. Ribs 71 are formed at right and left ends of the upper and lower outer surfaces of the fit-on tube 70. The upper and lower ribs 71 are fit tightly between the upper and lower walls of the mounting hole 41.

An escape groove 72 is formed on a right side wall of the fit-on tube 70 in a front view and can receive the rib 45 formed on the right surface of the mounting hole 41

A locking mechanism is provided between the fit-on tube 70 of the cover 60 and the mounting tube 44 inside the mounting hole 41. More specifically, as shown in FIG. 11, locking projections 47 are formed on upper and lower surfaces of the mounting tube 44 at central positions in the width direction and near the front end. Further locking grooves 73 are formed on upper and lower surfaces of the fit-on tube 70. The locking projections 47 fit in the locking grooves 73 when the fit-on tube 70 is pressed to the predetermined normal position inside the mounting hole 41.

The shielding shell 80 is mounted on the rear end of the female housing 35. The shielding shell 80 is formed by press working or deep drawing a metal plate, such as an aluminum plate, to form an oblong tubular shape that can be fit on the rear end of the female housing 35. A flange 81 projects at a front edge of the shielding shell 80 and can be mounted on the female housing 35. A mountain shaped extended part 82 projects at an upper part of the flange 81 and has an insertion hole 83 for receiving the bolt 14.

The shielding shell 80 is fitted on the female housing 35 from the rear and guide ribs 75 on the outer surface of the rear end of the female housing 35 guide this fit-on operation. Two guide ribs 75 are formed on of each of the upper and lower surfaces of the female housing 35 and one guide rib 75 is formed at a central portion of right and left vertical surfaces of the female housing 35.

Each guide rib 75 extends from a rear edge of the female housing 35 and continues forward for about ⅓ of the whole length of the female housing 35. A high projection 75A is formed at a front end of each guide rib 75 and tapers down to the rear.

Stoppers 76 project perpendicularly out from the outer surface of the female housing 35 at the front end of each guide rib 75.

Locking strips 78 are cantilevered on the upper and lower surfaces of the female housing 35 between the corresponding pairs of guide ribs 75. A locking projection 79 is formed at the front end of the locking strip 78 for locking the rear edge of the shielding shell 80 thereto.

Figure 19:
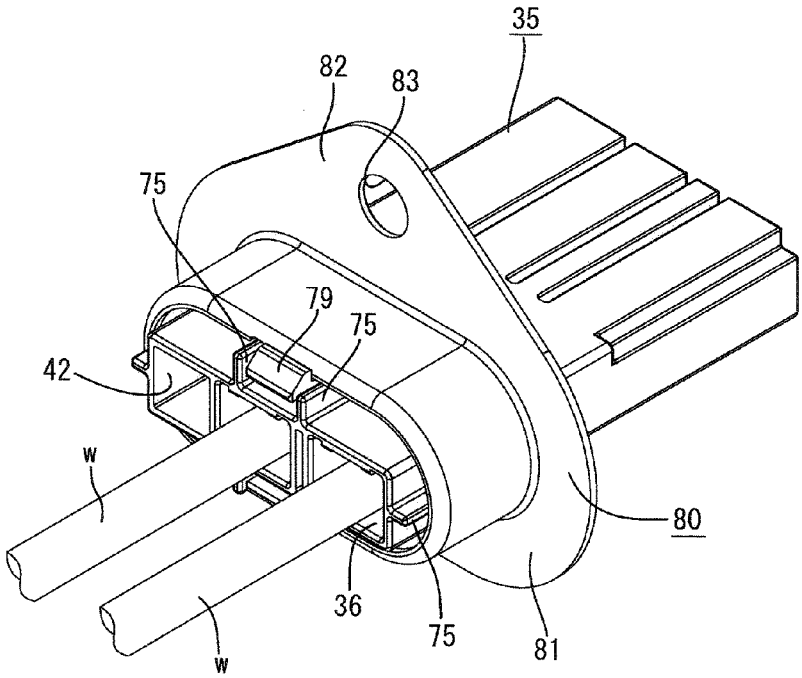
FIG. 19 is a perspective view as viewed from a rear surface of the harness-side connector.

The shielding shell 80 is fit on the female housing 35 from the rear along the guide rib 75 with the locking strip 78 being elastically flexed. The shielding shell 80 is pressed at the last stage of the fit-on operation, with the front edge thereof being tightly fit on the high projection 75A of the guide rib 75. The pressing operation is stopped when the front edge of the shielding shell 80 strikes against the stopper 76. At that time, the locking strip 78 elastically returns to its original state and the locking projection 79 locks the rear edge of the shielding shell 80 thereto. Thus, as shown in FIG. 19, the shielding shell 80 is mounted on the periphery of the rear end of the female housing 35 without being loosened and is prevented from being removed.

The shielding shell 80 mounted on the female housing 35 in the above-described manner is fixed to the outer surface of the case 10. Therefore the opening 11 of the case 10 is sized to fit the six stoppers 76 on the inner side of the opening 11.

The fit-on detection part 40 is mounted on the harness-side connector 30. Initially the shorting terminal 50 placed in the state shown in FIGS. 10 and 11 is pressed into the press-fit groove 46 of the mounting tube 44 formed at the rear in the mounting hole 41 and fixed thereto. At this time, as shown in FIG. 23, about the front 80 percent of both pins 52 of the shorting terminal 50 project from the front surface of the mounting tube 44.

Thereafter, the rear connection parts 57 of the right and left relay terminals 55 are pressed onto the pins 52 with the base plates 56 disposed at the upper side thereof. Each of the relay terminals 55 is stopped when the rear end thereof strikes against the front surface of the mounting tube 44. At this time, the front end of each pin 52 enters between the elastic contact strip 57A and the bottom surface of the connection part 57 opposed thereto with the pin 52 elastically flexing the elastic contact strip 57A and reaches a position beyond the apex of the elastic contact strip 57A.

The cover 60 then is inserted into the mounting hole 41 from the side of the fit-on tube 70 and in a posture with the four ribs 71 on the upper and lower outer surfaces of the fit-on tube 70 oriented to form an "H" shape and with the two tab insertion openings 65 in a lower region of the front surface of the cover body 61, as shown in FIG. 17. The outer surface of the fit-on tube 70 and the ribs 71 are fit tightly on the inner peripheral surface of the mounting hole 41. Thus, the cover 60 is not loosened and is pressed into the mounting hole 41 in a straight posture along the axis of the mounting hole 41.

Each relay terminal 55 enters the fit-on tube 70 from the rear as the operation of pressing the cover 60 proceeds. Thereafter the relay terminal 55 moves into the corresponding accommodation chamber 64 of the cover body 61 and moves forward relative to the cover body 61 with the stabilizer 59 of the relay terminal 55 being fit in and guided by the guide groove 66. The cover 60 is pressed into the mounting hole 41 during the last stage of the pressing operation. Hence, the fit-on tube 70 fits tightly on the periphery of the mounting tube 44 and the rib 45 fits in the escape groove 72. The stabilizer 59 of the relay terminal 55 will strike against the edge of the entrance of the accommodation chamber 64 if the cover 60 is inserted into the mounting hole 41 upside down, thereby preventing pressing of the cover 60. Even if the pressing operation continues, the rear edge of the side wall of the fit-on tube 70 without the escape groove 72 will strike against the rib 45 to prevent further pressing. Thus, an erroneous posture of the cover 60 is detected. The cover 60 then is turned upside down to correct the erroneous posture and is inserted again into the mounting hole 41.

The operation of pressing the cover 60 is stopped when the front surface of the front connection part 57 of each relay terminal 55 is pressed and strikes against the front wall 64A of the corresponding accommodation chamber 64. At this time, as shown in FIG. 23, the locking projection 47 of the mounting tube 44 is fit on the rear edge of the locking groove 73 of the fit-on tubular part 70. Thus, the cover 60 is mounted in the mounting hole 41 and is prevented from being removed.

At this time, each relay terminal 55 is accommodated completely inside the accommodation chamber 64 of the cover body 61 over the entire length thereof. The front surface of the cover body 61 is disposed almost flush with the opening disposed at the front end of the mounting hole 41 with the front connection part 57 of the relay terminal 55 being positioned immediately rearward from the tab insertion opening 65 of the front wall 64A of each accommodation chamber 64. As described above, a predetermined amount of the corresponding pin 52 of the shorting terminal 50 is inserted into the rear connection part 57. Thus the relay terminal 55 and the shorting terminal 50 are connected normally. The clearance 62 is formed between the peripheral surface of the cover body 61 and the inner peripheral surface of the mounting hole 41 and can receive the projected wall 29 erect on the periphery of the male tab 28 disposed in the fit-on detection part 27 of the equipment-side connector 20.

The shielding shell 80 then is mounted tightly on the rear of the female housing 35 in the above-described manner. The locking strip 78 prevents the shielding shell 80 from being removed. At this time, the female terminal 31 connected to the end of the electric wire w is inserted into the cavity 36 of the female housing 35 and is prevented from being removed. A shielding cylindrical body (not shown) consisting of a braided wire is fit on both electric wires w and connected to the shielding shell 80.

As shown with an arrow X of FIG. 1, the female housing 35 of the harness-side connector 30 is fit in the fit-on concavity 23 of the male housing 21 of the equipment-side connector 20 through the opening 11 of the case 10.

Figure 20:
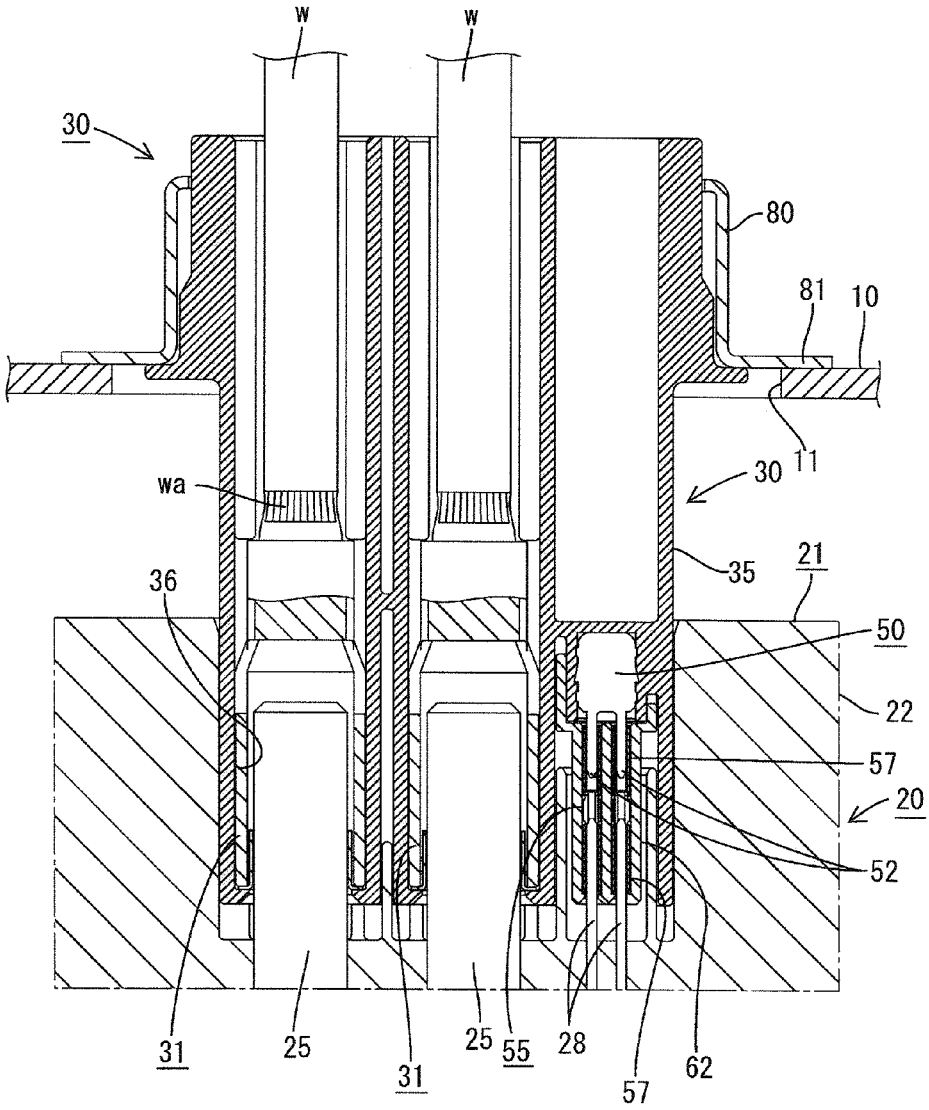
FIG. 20 is a sectional view showing a state in which the equipment-side connector and the harness-side connector have been normally fitted on each other.
Figure 21:
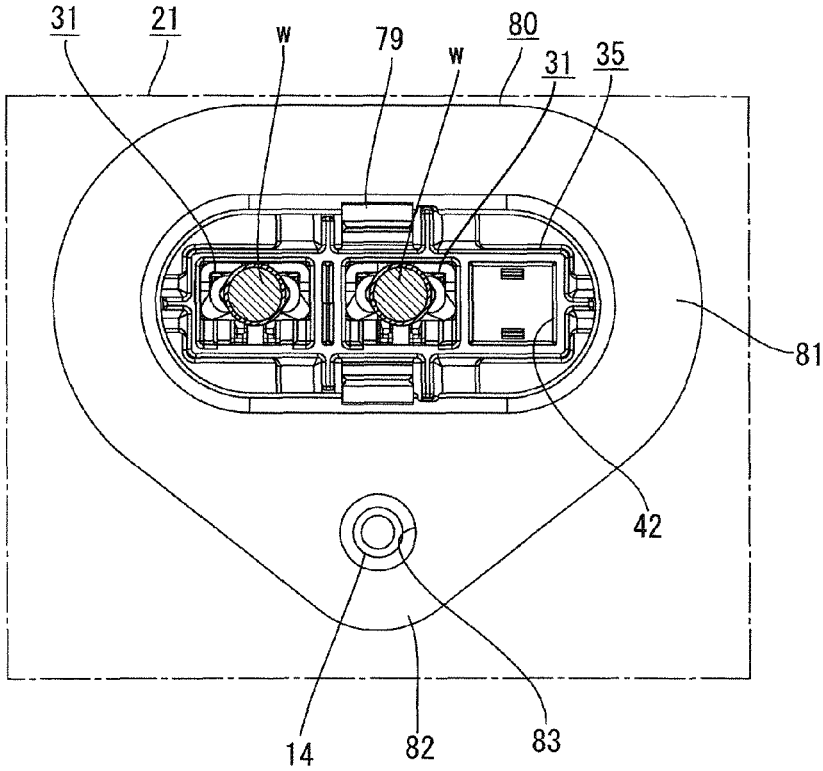
FIG. 21 is a plan view showing the state in which the equipment-side connector and the harness-side connector have been normally fitted on each other.

As shown in FIG. 20, the pressing operation is stopped when the flange 81 of the shielding shell 80 mounted on the harness-side connector 30 strikes against the periphery of the opening 11. That is, the female housing 35 is fit normally in the fit-on concavity 23 of the male housing 21. Meanwhile, as shown in FIG. 21, the bolt 14 projected from the edge of the opening 11 of the case 10 is inserted through the insertion hole 83 of the extended part 82 of the flange 81 of the shielding shell 80. The flange 81 then is fixed to the case 10 by screwing a nut with the bolt 14 and tightening the nut.

The bus bars 25 of the equipment-side connector 20 and the corresponding female terminals 31 of the harness-side connector 30 are connected normally to each other. Further the region in the range from the electric wire w to the portion where the bus bars 25 and the corresponding female terminals 31 are fit together is shielded.

The operation of fitting the connectors 20 and 30 together proceeds with the cover 60 of the fit-on detection part 40 of the harness-side connector 30 being fit on the inner side of the wall 29 on the fit-on detection part 27 of the equipment-side connector 20. Thus, the male tabs 28 move toward the front surface of the cover 60 and move through the tab insertion opening 65 of the front wall 64A of the accommodation chamber 64 and into the front connection part 57 of the relay terminal 55 accommodated therein. The front end of each male tab 28 moves between the elastic contact strip 57A and the bottom surface of the connection part 57 and elastically flexes the elastic contact strip 57A. The front end of the male tab 28 passes the apex of the elastic contact strip 57A and reaches a position near the entrance of the gap 58 between the front and rear connection parts 57 when both housing 21 and 35 have been fit normally together, as shown in FIGS. 20 and 23. Thus, the male tab 28 and the front connection part 57 of the relay terminal 55 corresponding thereto are connected electrically to each other.

The fit-on detection male tabs 28 of the equipment-side connector 20 are connected to both relay terminals 55 via the shorting terminal 50, and the power supply electric circuit provided on the equipment-side connector 20 becomes conductive, thereby detecting that both housing 20 and 30 have been fit normally together.

The J/B 22 of the equipment-side connector 20 is mounted in the case 10 with a bolt or the like. A variation may occur between the dimension of the opening 11 of the case 10 and the dimension of the open plane of the fit-on concavity 23 of the male housing 21 due to manufacturing tolerances. Thus, a variation may occur in the fit-on depth of the male housing 35 of the harness-side connector 30 when the female housing 35 is fit in the fit-on concavity 23 of the male housing 21 of the equipment-side connector 20. Hence, there is a fear that proper connection between the housings 20 and 30 will not be detected. However, the fit-on detection part 40 of the harness-side connector 30 is formed by connecting the relay terminal 55 to the shorting terminal 50.

Figure 24:
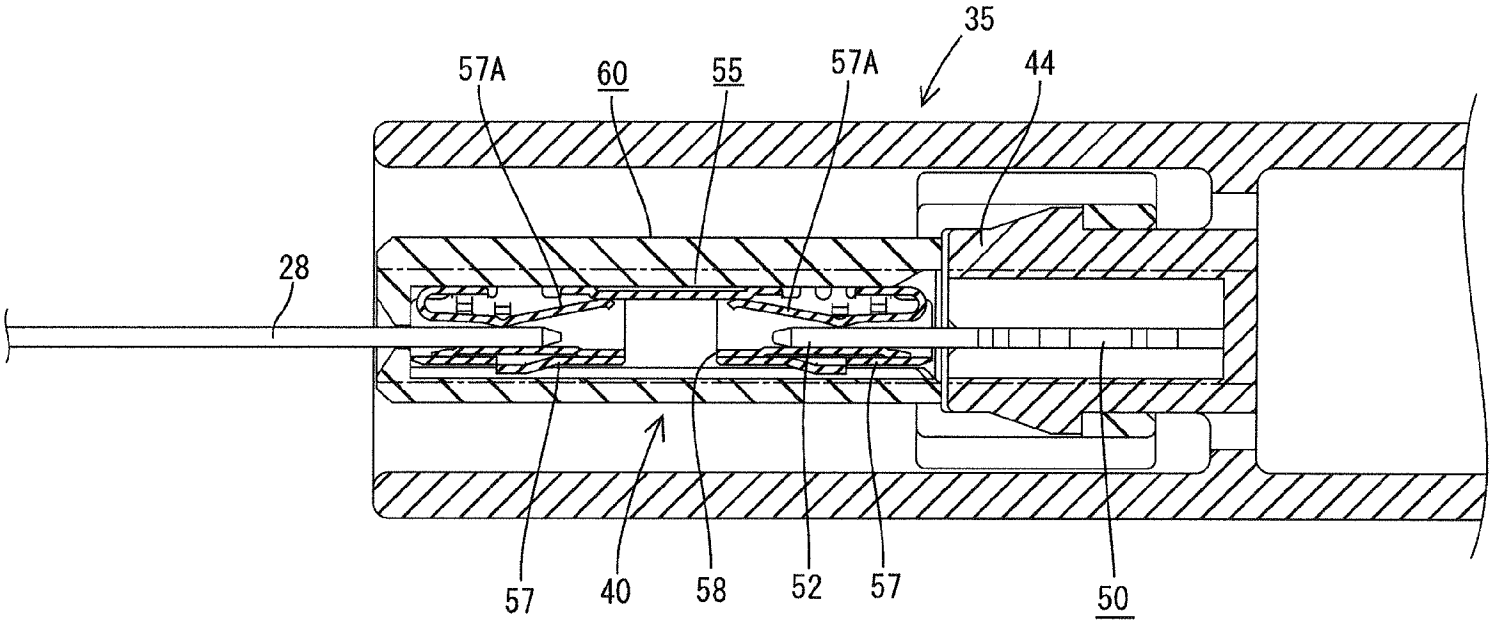
FIG. 24 is a sectional view showing the fit-on detection mechanism in the case where the equipment-side connector has been mounted on the harness-side connector at an upper-limit side of the tolerance range.

Therefore as shown with the arrow A of FIG. 1, in the case where the open plane of the fit-on concavity 23 of the male housing 21 is spaced at a long interval from the opening 11 of the case 10 within the mounting tolerance (i. e. the fit-on depth of the male housing 35 in the fit-on concavity 23 of the male housing 21 is short, as shown in FIG. 24) the front end of the male tab 28 reaches the position exceeding the apex of the elastic contact strip 57A of the front connection part 57 of the relay terminal 55 even though the advanced dimension of the male tab 28 into the cover 60 is short. Thus an electrical connection between the male tab 28 and the connection part 57 is secured.

Figure 25:
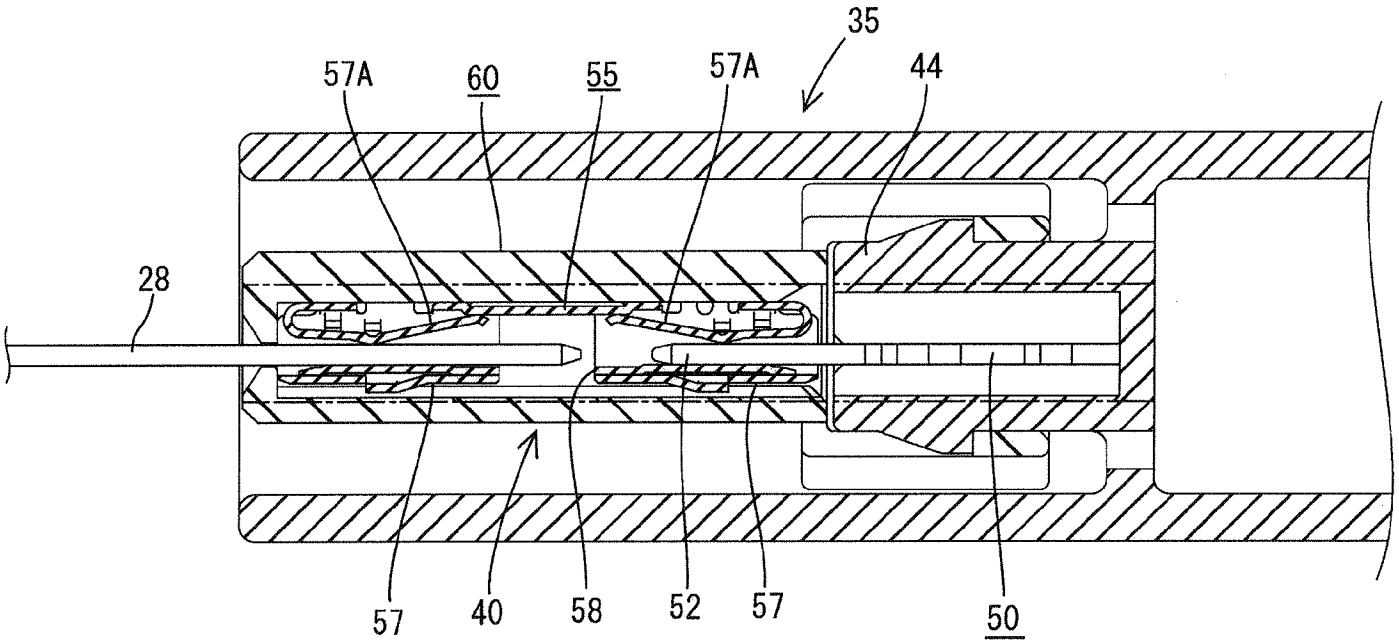
FIG. 25 is a sectional view showing the fit-on detection mechanism in the case where the equipment-side connector has been mounted on the harness-side connector at a lower-limit side of the tolerance range.

As shown with the arrow B of FIG. 1, in the case where the open plane of the fit-on concavity 23 of the male housing 21 is spaced closely to the opening 11 of the case 10 within the mounting tolerance (i. e. the fit-on depth of the male housing 35 in the fit-on concave part 23 of the male housing 21 is long, as shown in FIG. 25) the front end of the male tab 28 stays within the gap 58 between the front connection part 57 and the rear connection part 57. However, the advanced dimension of the male tab 28 into the cover 60 is long and thus the front end of the male tab 28 advances into the cover 60 and exceeds the front connection part 57 of the relay terminal 55. Thus, the front end of the male tab 28 does not interfere with the rear connection part 57 or the like, and an electrical connection between the male tab 28 and the front connection part 57 is secured.

Consequently, proper connection of the housings 20 and 30 can be detected correctly irrespective of the degree of an error within the tolerance in mounting the J/B 22 of the equipment-side connector 20 on the case 10.

As described above, the fit-on detection part 40 of the harness-side connector 30 has the shorting terminal 50 and the relay terminal 55. Thus, tolerance in mounting the equipment-side connector 20 on the case 10 can be absorbed in the gap 58 between the front and rear connection parts 57 of the relay terminal 55 and connection between the housings 20 and 30 can be detected securely. The shorting terminal 50 and the relay terminal 55 are existing articles. Thus the construction is not expensive.

The fit-on detection part 40 of the harness-side connector 30 can be assembled by sequentially inserting the shorting terminal 50, the relay terminal 55 and the cover 60 into the mounting hole 41 so that assembly work is performed efficiently.

The cover 60 is mounted in the mounting hole 41 with the wall 29 of the fit-on detection part 27 of the equipment-side connector 20 being fit in the clearance 62 between the peripheral surface of the cover body 61 and the inner surface of the mounting hole 41. The fit-on tube 70 is formed continuously with the rear end of the cover body 61 and is larger than the cover body 61. In addition the rib 71 is formed on the upper and lower outer surfaces of the fit-on tube 70. Thus, the outer configuration of the fit-on tube 70, including the rib 71, can fit tightly on the inner peripheral surface of the mounting hole 41. Therefore, the cover 60 can be inserted smoothly into the mounting hole 41, without shifting radially, and the relay terminal 55, which has been mounted in the mounting hole 41 in advance, is accommodated smoothly inside the accommodation chamber 64. As a result, the work of inserting the cover 60 into the mounting hole 41 is performed efficiently.

The invention is not limited to the embodiments described above with reference to the drawings. For example, the following embodiments are also included in the technical scope of the present invention.

The relay terminal can be accommodated inside the cover in advance and the cover can be pressed toward the mounting hole to insert the short pin mounted in the press-fit groove by press fit into the relay terminal.

The illustrated fit-on concavity is formed in the outer surface of the J/B. However, a hood may be formed on the outer surface of the J/B and the fit-on concavity may be inside the hood.

The configuration of the shielding shell and the number of positions to be fixed to the case may be varied from those shown in the illustrated embodiment.

The invention also is applicable to an apparatus with a connector disposed at the rear side of a panel and fit to a mating connector through an opening in the panel.

The invention is also applicable to a waterproof connector apparatus.

What is claimed is:

1. A connector apparatus comprising:

an equipment case with an opening;

an equipment-side connector having at least one equipment connection terminal, the equipment-side connector being disposed inside the case and facing the opening;

a harness-side connector connected to an end of a wire harness and having at least one harness connection terminal to be connected to the equipment connection terminal, the harness-side connector being connected with the equipment-side connector through the opening of the case; and fit-on detection mechanisms disposed at said equipment-side connector and said harness-side connector for detecting connection between the equipment-side connector and the harness-side connector, the fit-on detection mechanism of the equipment-side connector comprising two fit-on detection male terminals, and the fit-on detection mechanism of the harness-side connector comprising a shorting terminal and two relay terminals, the shorting terminal having a coupling and two pins projecting from the coupling, each of the relay terminals having two spaced apart connection parts formed at opposite ends thereof and connecting the pins of said shorting terminal with the male terminals.

2. The connector apparatus of claim 1, further comprising a mounting part provided on said harness-side connector and being fixed to the case.

3. The connector apparatus of claim 1, wherein the harness-side connector has a front end and a mounting hole open at the front end, a press-fit groove being formed on an inner surface of the mounting hole, the coupling of the shorting terminal being press fit into the press-fit groove.

4. The connector apparatus of claim 3, further comprising a cover insertable into the mounting hole from the front end of the harness-side connector, the cover having two accommodation chambers and the relay terminals being disposed respectively in the accommodation chambers, terminal insertion openings being formed respectively at front ends of the accommodation chambers for receiving the fit-on detection male terminals respectively.

5. The connector apparatus of claim 4, further comprising removal prevention parts formed between the cover and the mounting hole for preventing removal of the cover.

6. The connector apparatus of claim 4, wherein the cover is mounted inside said mounting hole of said harness-side connector with a clearance between an inner peripheral surface of said mounting hole and a peripheral surface of said cover, the equipment-side connector including a wall at least partly surrounding the male terminals, the wall being insertable into the clearance between the inner peripheral surface of said mounting hole and the peripheral surface of said cover.

7. The connector apparatus of claim 6, further comprising ribs formed on an outer surface of said cover for preventing for preventing lateral shifting of the cover.

8. The connector apparatus of claim 1, wherein a power supply electric circuit on the equipment-side connector is conductive when the fit-on detection male terminals are connected electrically to each other, whereas said power supply electric circuit is cut off when the fit-on detection male terminals are not connected electrically to each other.

9. The connector apparatus of claim 1, wherein said equipment case is made of a metal; a shielding shell being mounted on said harness-side connector with said shielding shell surrounding the terminal; a mounting plate projecting from the shielding shell and being fixed to an outer surface of the equipment case with a tightening metal fitting.

* * * * *